US007247845B1

(12) United States Patent
Gebhardt et al.

(10) Patent No.: US 7,247,845 B1
(45) Date of Patent: Jul. 24, 2007

(54) METHOD AND DEVICE FOR CLUSTER FRAGMENTATION

(75) Inventors: Christoph Gebhardt, München (DE); Hartmut Schroder, München (DE)

(73) Assignee: Max-Planck Gesellschaft zur Forderung der Wissenschaften e.V., Munich (DE)

( * ) Notice: Subject to any disclaimer, the term of this patent is extended or adjusted under 35 U.S.C. 154(b) by 238 days.

(21) Appl. No.: 10/031,542

(22) PCT Filed: Jul. 20, 2000

(86) PCT No.: PCT/EP00/06956

§ 371 (c)(1),
(2), (4) Date: Jan. 18, 2002

(87) PCT Pub. No.: WO01/08196

PCT Pub. Date: Feb. 1, 2001

(30) Foreign Application Priority Data

Jul. 21, 1999 (DE) ..... 199 34 173

(51) Int. Cl.
*H01J 49/26* (2006.01)

(52) U.S. Cl. ..... 250/281; 250/282; 376/108

(58) Field of Classification Search ..... 250/281
See application file for complete search history.

(56) References Cited

U.S. PATENT DOCUMENTS 4,378,499 A * 3/1983 Spangler et al. ..... 250/287
4,755,344 A * 7/1988 Friedman et al. ..... 376/108
4,845,367 A * 7/1989 Amirav et al. ..... 250/423 R
4,851,669 A * 7/1989 Aberth ..... 250/281
4,935,623 A * 6/1990 Knauer ..... 250/251
5,051,582 A 9/1991 Bahns et al.
5,053,343 A * 10/1991 Vora et al. ..... 436/153
5,239,820 A 8/1993 Leifer et al.
5,338,931 A * 8/1994 Spangler et al. ..... 250/287
5,577,092 A * 11/1996 Kublak et al. ..... 378/119
5,767,511 A 6/1998 Macler
5,780,862 A 7/1998 Siess
5,828,063 A 10/1998 Köster et al.

OTHER PUBLICATIONS

J Abboud et al, Critical Compilation of Scales of Solvent Parameters. Part I. Pure, Non-Hydrogen Bond Donor Solvents, 1999, Pure and Applied Chemistry, vol. 71, No. 4, p. 653.*
W. Skinner et al. In "Vacuum Solutions", Mar./Apr. 1999, p. 29 et seq.

(Continued)

*Primary Examiner*—Nikita Wells
*Assistant Examiner*—Phillip A. Johnston
(74) *Attorney, Agent, or Firm*—Robert A. Koons, Jr.; Matthew P. McWilliams; Drinker Biddle & Reath LLP

(57) ABSTRACT

A method for cluster fragmentation comprises the production of at least one cluster which contains a carrier substance and the fragmentation of the cluster into cluster fragments, with the cluster being loaded before the fragmentation with at least one reaction partner and the reaction partner being part of at least one cluster fragment after the fragmentation. A cluster beam system for performing the method, and applications of the cluster fragmentation for analysis and purification of surfaces, for analysis of clusters, and for the operation of ion thrusters are also described.

30 Claims, 5 Drawing Sheets

OTHER PUBLICATIONS

A. A. Vostrikov et al. in "Chemical Physics Letters", vol. 139, 1987, p. 124 et seq.
A. A. Vostrikov et al. in "Z. Phys. D", vol. 20, 1991, p. 61 et seq.
A. A. Vostrikov et al. in "Z. Phys. D", vol. 40, 1997, p. 542 et seq.
Wolfgang Christen et al. in "Ber. Bungsenges. Phys. Chem."vol. 96, 1992, p. 1197 et seq.
P. U. Andersson et al. in "Z. Phys. D", vol. 41, 1997, p. 57 et seq.
R. Takasu et al. in "J. Phys. Chem. A.", vol. 101, 1997, p. 3078 et seq.
I. V. Hertel et al. in "Phys. Rev. Lett.", vol. 67, 1991, p. 1767 et seq.
R. N. Barnett et al. in "Phys. Rev. Lett.", vol. 70, 1993, p. 1775 et seq.
K. S. Kim et al. in "Phys. Rev. Lett.", vol. 76, 1996, p. 956 et seq.
D. Feller et al. in "J. Chem. Phys.", vol. 100, 1997, p. 4981 et seq.
C. P. Schulz et al. in "Clusters of atoms and molecules II", editor H. Haberland, Springer 1984, pp. 7-11.
O. S. Hagena et al in "J. Chem. Phys.", vol. 56, 1972, p. 1793 et seq.
Chem. Phys. Lett., vol. 139 (1987), S. 124-128.
C. Mair et al. in "Intern. Journal of mass spectrometry", 1999, vol. 188, No. 3.
L. W. Tao-Chin et al. in "American society for mass spectrometry", 1996, pp. 293-297.

* cited by examiner

METHOD AND DEVICE FOR CLUSTER FRAGMENTATION

The present invention relates to a method for cluster fragmentation, particularly a cluster fragmentation method for producing particles which are differently electrically charged and/or for manipulating electrically neutral particles, and devices for cluster fragmentation. The invention also relates to applications of cluster fragmentation for substance analysis at boundary surfaces, for purifying surfaces, and in the design of ion sources and/or ion thrusters, and applications in which clusters (and/or aerosols), particularly those of natural origin, are to be analyzed in regard to their quantity and/or composition.

The influencing and/or detection of electrically neutral particles is connected with a relatively high technical outlay due to their only weakly occurring interaction with the environment. The Coulomb interaction of electrically charged particles, in contrast, allows simple manipulation using electromagnetic fields and also simplified detection, e.g. through direct electrometric measurement. Therefore, there is interest in the conversion of electrically neutral atoms, molecules, and corresponding atom or molecule groups into corresponding charged particles (ionization). In general, the transition from the electrically neutral to the charged particle occurs by adding at least one charge carrier, e.g. an electron, to a neutral particle and/or by removing charge carriers, so that a net charge remains on the originally neutral particle. The most important generally known ionization techniques include electron impact ionization, laser ionization, electron attachment, and plasma ionization.

In the known methods for producing positive ions, as a rule a single stage ionization occurs in which the energy supplied practically instantaneously to the neutral particle is sufficiently great to separate at least one electron completely from the cation which arises. The separated electrons are normally not used further, so that only one relevant charge carrier may be produced per ionization energy unit applied.

A general problem in conventional ionization is the quantitative conversion of neutral particles into corresponding ions. The degree of ionization (ratio of the number of ionized particles to the number of neutral particles originally present) desired, which is as close as possible to one, is only achieved with high technical outlay. Frequently the ionization is connected with destruction of the original neutral particles. The typical ionization techniques are restricted to the production of light ions (charged molecules or molecule groups). In various fields of application, e.g. in surface processing and in the operation of ion thrusters, however, there is interest in the production of particularly many and particularly heavy ions.

Not only is the influencing and detection of electrically neutral particles connected with technical difficulties, but also their transfer into the gas phase: particularly for larger molecular structures, such as biologically relevant macromolecules or DNA fragments, the interaction with the carrier material or the surrounding solvent is so strong that upon an attempt at removal or dissolving, intramolecular bonds may also be broken and thus the transfer into the gas phase is accompanied by destruction of the starting substance.

The molecule is as a rule also strongly heated by the transfer procedure (excitation of rotation, oscillation, and electronic degrees of freedom). In the gas phase, the molecule has no efficient way to dissipate this excess energy (no coupling to a heat sink). As a consequence, breaking of molecular bonds or denaturing may occur in turn. A spectroscopic analysis is also prevented by the high state of excitation. The careful transfer of larger molecules into the gas phase is of technical significance, for example as the first step of a mass spectrometry analysis.

The MALDI method (matrix assisted laser distortion ionization) represents a known method for the transfer of larger molecules into the gas phase (e.g. U.S. Pat. No. 5,828,063). However, the costs of the laser necessary for this purpose greatly restrict the application.

The production of atom or molecule structures in the form of clusters is generally known. Clusters are of interest both due to their special material properties, which may be differentiated from the solid state, and as manipulable particles, e.g. in the modification or purification of surfaces. For example, applications of ionized clusters made of gas atoms in surface processing are described by W. Skinner et al. ("Vacuum Solutions", March/April 1999, p. 29 et seq.).

A known method for producing ionized particles is given by the cluster fragmentation of water and sulfur dioxide clusters, which, however, has only been of theoretical significance until now for the reasons discussed below. Thus, for example, A. A. Vostrikov et al. describe the ionization of water clusters upon their impact on solid surfaces in "Chemical Physics Letters" Vol. 139, 1977, p. 124 et seq., in "Z. Phys. D", Vol. 20, 1991, p. 61 et seq., and in "Z. Phys. D", Vol. 40, 1997, p. 542 et seq. Furthermore, the ionization of $SO_2$ clusters upon mechanical scattering on single crystal surfaces is known from the publication of Wolfgang Christen, Karl-Ludwig Kompa, Hartmut Schröder, and Heinrich Stülpnagel in "Ber. Bungsenges. Phys. Chem.", Vol. 96, 1992, p. 1197 et seq. The formation of ionized cluster fragments upon the impact of $H_2O$ clusters on surfaces is explained with the autoprotolysis of the water according to $H_2O \rightarrow H^+ + OH^-$. The ions $H^+$ or $OH^-$ found in various particles of the cluster at the instant of impact are separated from one another by the fragmentation and are carried along with various cluster fragments, which are then externally electrically charged.

The ionization by cluster fragmentation has not had any practical significance until now, since it is restricted to $H_2O$ and/or $SO_2$ and has an extremely low efficiency. Thus, for example, in normal conditions in water only every $10^9$th particle is ionized. Correspondingly, the probability of the production of charged cluster fragments is extraordinarily low. Further experiments in the cluster fragmentation of $H_2O$ (see publication of P. U. Andersson et al. in "Z. Phys. D", Vol. 41, 1997, p. 57 et seq.) are directed toward the influence of an electron transfer from the surface hit by cluster into the cluster and to the ionization of the cluster fragments connected with this.

Investigations of the electronic properties of clusters doped with metal atoms are also known. Thus, an electron delocalization for alkali atoms in molecule clusters is described by R. Takaso et al. in "J. Phys. Chem. A", Vol. 101, 1997, p. 3078 et seq. and by I. V. Hertel et al. in "Phys. Rev. Lett.", Vol. 67, 1991, p. 1767 et seq. Furthermore, the behavior of sodium in $H_2O$ and/or $NH_3$ clusters is described by the publications of R. N. Barnett et al. in "Phys. Rev. Lett.", Vol. 70, 1993, p. 1775 et seq., K. S. Kim et al. in "Phys. Rev. Lett.", Vol. 76, 1996, p. 956 et seq., and by D. Feller et al. "J. Chem. Phys.", Vol. 100, 1994, p. 4981 et seq. It was established that sodium in the dissolved state effects a reduced ionization potential in the cluster. Practical applications have not yet been able to be derived from this. The investigations up to this point of the electronic properties of, for example, sodium in clusters were performed in longlived equilibrium states which, however, have not yet permitted any conclusions on the dynamics of the behavior of charge carriers in clusters.

Production of charge carrier pairs by alkali atoms in clusters made of water, ammonia, and acetonitrile has also been described (see C. P. Schulz et al. in "Clusters of atoms and molecules II", editor H. Haberland, Springer 1984, pp. 7-11).

It is the object of the present invention to provide an improved cluster fragmentation method for producing charged particles and/or for manipulating electrically neutral particles that is particularly applicable with an extended range of substances and has an elevated and controllable efficiency. It is also the object of the present invention to indicate devices for implementing a method of this type. Furthermore, the object of the invention is the description of novel possible applications for charged or uncharged cluster fragments which are produced with the improved cluster fragmentation method.

These objects are achieved by the subjects of the patent claims 1, 21 and 29. Advantageous embodiments and further applications of the invention arise from the dependent claims.

The basic idea of the invention is to refine conventional cluster fragmentation methods in such a way that before the actual fragmentation, e.g. by mechanical impact of a cluster on a boundary surface, the cluster is loaded with a reaction partner. The reaction partner comprises single atoms or molecules, atom or molecule groups, or is a cluster or cluster fragment itself.

In this case, cluster generally refers to groups of atoms or molecules or atom or molecule aggregates relatively weakly bonded by purely physical forces (e.g. van der Waals forces or hydrogen bridge bonds) whose internal volume density is comparable with the density of solid bodies but which nonetheless have the character of a gas phase particle externally. The (average) cluster size is set depending on the application and may extend from a few particles (e.g. around 10) to large numbers of particles (e.g. one or more thousands). The clusters could even be as large as macroscopic aerosol particles.

According to an embodiment of the invention, the reaction partner comprises electrically neutral molecules which may be absorbed into the cluster fragments by physical interaction with the carrier substance.

According to a further embodiment of the invention, the reaction partner has the capability of producing a pair of electrically differently charged charge carriers with the particles of the cluster material (carrier substance). During the induced fragmentation of the cluster, these produced charge carriers may come to rest on different fragments of the fragmented cluster and be separated in space by the inertial movement of the cluster fragments. In contrast to the original cluster, in which the charge carriers mutually neutralize one another to the outside, the mutual shielding disappears through the spatial separation of the fragments and thus of the individual charge carriers, so that the charged cluster fragments which are separated from one another form externally electrically charged free particles, which are also referred to in the following as ions. In place of the distribution of the charge carriers produced onto various fragments, with suitable method control, the exclusive production of positively charged fragments may also be provided, while the negative charge carriers drain off to the respective boundary surface.

The charge carrier pair production occurs spontaneously through a chemical reaction or an ionization of the reaction partner or, alternatively, through external excitation, in that, for example, a charge carrier transfer is induced by light irradiation or mechanical impact. The probability that the charge carriers are located on different fragments may be influenced by the selection of cluster size, cluster speed, and fragmentation conditions. In general, the probability increases if charge carriers arise as reaction products which have a high movability within the cluster (e.g. electrons or protons in clusters bonded by hydrogen bridges), since in this case there is already spatial separation within the cluster.

In a preferred embodiment, an ionization of the cluster fragments simultaneously occurs according to one of the methods according to the present invention.

The carrier substance, through which the clusters are formed, is preferably made of polar molecules, i.e. of molecules which have their own dipole moment, for example $H_2O$, $SO_2$, $NO_2$, $NH_3$, $NO_2$, $SF_n$, $CH_3CN$, $CHClF_2$, or isobutene. The polar molecules have the advantage of attenuating the Coulomb interaction in the ions found in the cluster. In addition, a polar environment generally encourages the progress of ionic reactions. Furthermore, the stronger dipole interaction of molecules eases the absorption of reaction partners. The carrier substance has a different chemical composition than the reaction partner(s).

The loading of the cluster to be fragmented with the reaction partner occurs during the cluster production, in the gas phase, or at the boundary surface immediately before the fragmentation. For this purpose, atoms or molecules or atom or molecule groups are deposited via the gas phase into the cluster(s) or deposited onto a surface positioned for cluster fragmentation. The reaction partner preferably comprises a substance which reacts with the carrier substance of the cluster to produce the charge carrier pair. In the case of polar carrier molecules, a substance with a low ionization energy, e.g. below 10 eV, is preferably selected as the reaction partner, particularly alkali atoms such as lithium, sodium, potassium, and cesium. The use of substances with an ionization potential this low has the advantage that electron emission occurs spontaneously inside the cluster made of polar molecules. The charge carriers arising with "high" efficiency at the same time may be efficiently separated by the method of cluster fragmentation according to the present invention. However, the method according to the present invention may, depending on the application, also be implemented with other reaction partners, particularly depending on the average cluster mass, the average cluster speed, and the strength of the dipole moment of the carrier substance molecules.

Cluster fragmentation generally occurs through energy input. During mechanical energy input, a collision of one or more clusters having a predetermined speed and/or speed distribution with a boundary surface, which represents a transition between the gas phase and a solid body or the gas phase and a liquid, occurs. The boundary surface may have any desired geometric shapes and is preferably formed in many applications by a solid substrate surface which adjoins a space in which the clusters are produced or accelerated. This has the advantage that, simply by positioning the boundary surface in the path passed through by the clusters, an interaction with the surface is ensured. This means that each cluster impacts on the surface and is fragmented with a probability of 1. The boundary surface does not generally has to be fixed. It may be particularly advantageous to elevate or reduce the relative speed between the cluster and a boundary surface purposely with the aid of a moving boundary surface, in order to thus influence the fragmentation behavior of the cluster. In addition, it is also possible that the boundary surface is formed by small droplets or by clusters in the gas phase.

Alternatively, a radiation energy input may be provided for cluster fragmentation, in that, for example, molecules in the cluster are subjected by laser radiation to excitation of electronic states or oscillation states.

Preferred applications of the method according to the present invention are in the modification, purifying, or analysis of solid surfaces, in the analysis of clusters and aerosol particles in regard to their quantity and composition, and in the provision of ion sources for measurement or analysis purposes or also for ion thrusters. According to a further application of the present invention it is provided that the cluster fragmentation method be used for manipulation of molecules which are neutral per se, in that the molecules to be manipulated are, like the reaction partner, absorbed by the cluster before the cluster fragmentation and are transferred into the cluster fragments. Through transfer into cluster fragments, molecules are transferred into the gas phase, possibly ionized by one of the methods according to the present invention in the course of the transfer, and thus made accessible to a manipulation or measurement known per se.

According to a further aspect of the present invention, a device for implementing the cluster fragmentation method mentioned is described in the form of a cluster radiation system. This device particularly features a cluster production device and a cluster fragmentation device as well as control, steering, and measurement devices for the cluster fragments. The cluster production device comprises a cluster source known per se. The cluster fragmentation device is adapted for the purpose of causing the cluster(s) provided by the cluster production device to impact on a boundary surface, implemented depending on the application.

The present invention has the following advantages. In contrast to the conventional ionization methods, the charge carrier production occurs in two stages. First, an externally neutral cation/anion pair is formed by the cluster loading with the reaction partner, which is then the separated by cluster fragmentation. A number of efficient chemical reactions are already available for the formation of the cation/anion pair. A further advantage is that the energy necessary for production of the charge carrier pair is significantly less than the energy for producing corresponding individual ions. The energy difference results from the mutual stabilization of the cation/anion pairs in the cluster due to the Coulomb interaction. This stabilization is removed by the fragmentation of the cluster only, with the energy for overcoming the mutual Coulomb attraction coming from the kinetic energy of the cluster fragments. The necessary ionization energy is thus supplied in two stages or parts according to the present invention.

This two-stage nature allows the use of various energy forms, which particularly also differ in the costs and the outlay for the provision of the respective energy. Thus, one part of the ionization energy may be provided by an "expensive" energy packet (e.g. a laser photon) and a further part by a "cheaper" energy packet (e.g. kinetic energy).

The Coulomb interaction is significantly reduced by the dielectric influence of the cluster medium (carrier substance) with the imbedding of the charge carrier pairs in the cluster. In contrast to the gas phase, the possibility of a spatial charge carrier separation in the cluster itself arises, which significantly reduces the quantity of energy necessary for production of free charge carriers.

An important advantage relative to typical ionization methods is that during each cluster fragmentation, depending on the method, equal quantities of positive and negative charge carriers are formed. High charge carrier densities in the form of a cation/anion plasma may be produced which are able to lie well above the density of charge carriers of one polarity delimited by the space charge.

The loading of the cluster with a reaction partner has the advantage that, for example, only a few charge carrier pairs whose number may be foreseen are produced in the cluster in a predetermined way. Since the energy for separation of the charge carrier pairs is determined by the kinetic energy of the incident clusters before the fragmentation, a connection between the maximum quantity of producible free charge carriers and the original kinetic energy is defined for a given average cluster size. During the loading of the cluster with the reaction partner, the quantity of charge carrier pairs produced per cluster may be adjusted to the kinetic energy of the cluster.

The cluster fragmentation according to the present invention provides an ionization method which is characterized by high efficiency and the capability of varying the masses of the ionized particles (ion masses) within wide ranges depending on the application. Typically, approximately 5% of the clusters impacting a solid surface are disaggregated into charged fragments according to the current knowledge. This represents a high value compared to the typical ionization methods. Furthermore, ion masses of up to a few thousand atomic mass units may typically be provided. This is particularly significant for the operation of ion thrusters.

In connection with the absorption of the reaction partner from a boundary surface, the cluster fragmentation according to the present invention allows the careful transfer of larger molecules into the gas phase as well. The absorption into the cluster and the transfer into a cluster fragment has the advantage that breaking of intramolecular bonds is avoided. Excessive excitation energy may be dissipated from the absorbed molecule onto the surrounding cluster fragments, so that very cold molecules which are easy to spectroscope may be transferred into the gas phase. The energy contained in the cluster fragments may be sufficient to completely evaporate the weakly bonded carrier gas molecules of the cluster fragment. In this case, the method has the advantage of transferring the absorbed molecules into the gas phase without the surrounding cluster envelope.

A particular advantage of the method is that, simultaneously with the transfer of a reaction partner (e.g. large molecule), its electrical charging may be effected by one of the procedures according to the present invention. In this case, the reaction partner may be supplied directly to an electromagnetic analysis method.

The cluster fragmentation method according to the present invention may also be especially advantageously applied for quantification and analysis of clusters and aerosol particles. The particles to be investigated may particularly be aerosol particles of natural origin, such as those which occur in the earth's atmosphere. These contain a majority of water and other polar molecules, so that they may be transferred into ionized fragments in a particularly simple way, e.g. by impact with a surface covered with an alkali metal. These ions could, for example, be supplied to a charge quantity measurement, in order to determine their concentration in the air volume examined, and/or to a mass spectrometry analysis for determining their composition. An aerosol fragmentation may be examined directly on board a measurement aerial vehicle (e.g. aircraft) using the relative speed between the aerial vehicle and the aerosol.

Further details and advantages of the invention are described with reference to the attached drawing.

The present invention is explained in the following for exemplary purposes in regard to the collision of clusters with solid, flat substrate surfaces. The present invention is also usable in a corresponding way for collisions at gas phase/liquid boundary surfaces and/or boundary surfaces with other shapes or with radiation-induced fragmentation. The figures merely show schematic, enlarged illustrations of clusters and cluster fragments, while dimensions and compositions are selected depending on the application according to the principles explained below.

Figure 1:
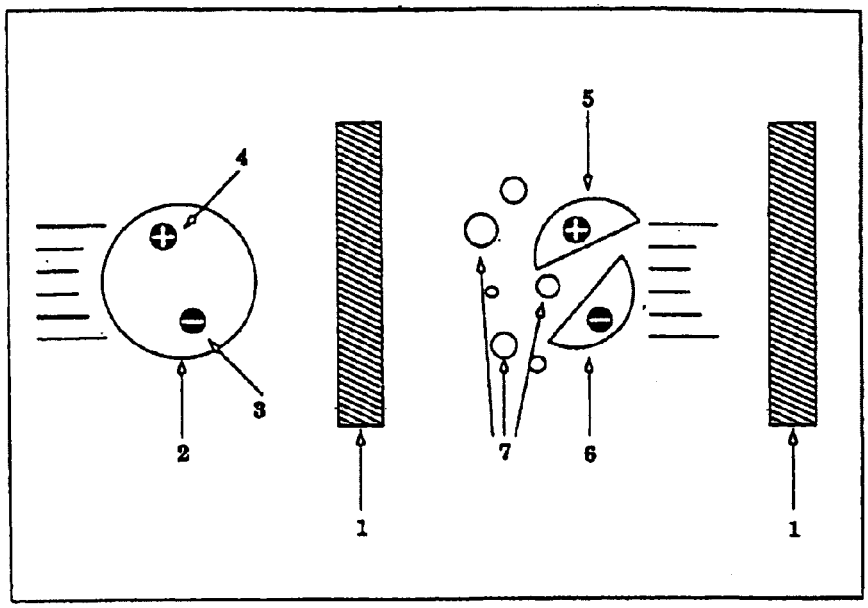
FIG. 1 shows an illustration of the charge carrier separation during cluster fragmentation according to the present invention.

FIG. 1 illustrates the principles of cluster fragmentation according to the present invention according to a first embodiment of the invention. In the left part of FIG. 1, the starting situation of a cluster 2 moving with a predetermined average speed relative to target 1 is shown. Target 1 forms the boundary surface for fragmentation in relation to the reaction chamber in which the cluster moves. Cluster 2 comprises a specific carrier substance which preferably at least partially contains molecules with a permanent molecular dipole moment. Cluster 2 is loaded with a reaction partner (not shown), which has undergone a chemical reaction with the carrier substance whose result has produced a charge carrier pair with different signs (anions 3, cations 4).

According to the present invention, the cluster to be fragmented is loaded with the reaction partner before the fragmentation. Depending on the application, this may occur even during the formation of the cluster. The reaction partner may particularly comprise the same material as the carrier substance of the cluster, i.e. the educts participating in the reaction may be components of the cluster itself. Alternatively, the loading occurs during the movement of the cluster toward the boundary surface.

Figure 2:
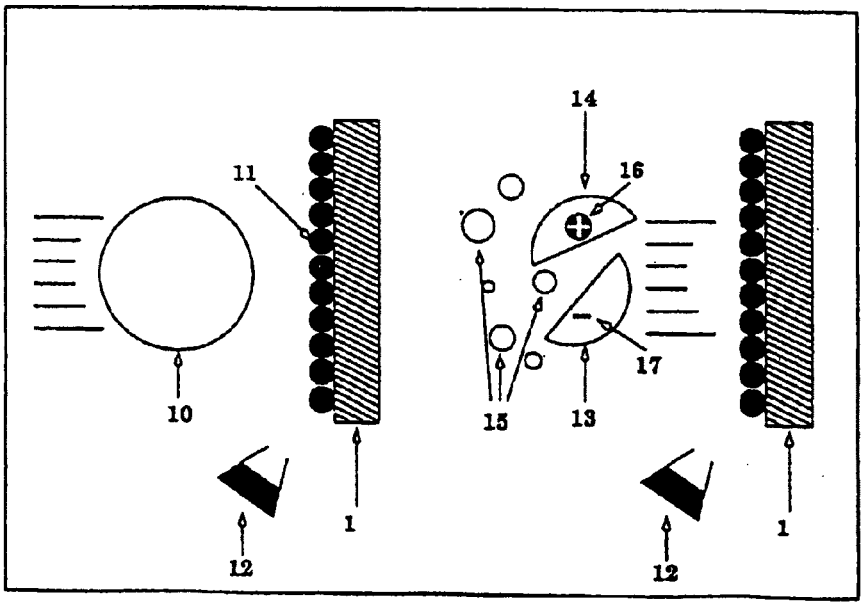
FIG. 2 shows an illustration of cluster loading at a boundary surface covered with reaction partners.

Finally, it is also possible that the loading only occurs at the boundary surface itself (see FIG. 2).

Cluster 2 is made of, for example, $SO_2$ molecules and is loaded with a Na atom. The loading is performed by collision of a cluster beam with a sodium atom beam or a sodium vapor. The reaction between the carrier substance sulfur dioxide and the reaction partner sodium comprises the spontaneous emission of an electron from sodium to the surrounding $SO_2$ molecules while forming sulfur dioxide anion 3 and sodium cation 4. Sulfur dioxide is preferred as the carrier substance for the cluster for the following reasons. It is chemically stable, does not display any hydrogen bonds or occurrences of autodissociation, and has a relatively high electron affinity (EA) of approximately 1 eV. This high EA value makes the formation of stable anion clusters easier. A further advantage of sulfur dioxide is that clusters may be produced easily at room temperature from this carrier substance (see below). In the left part of FIG. 1, cluster 2 also represents an externally neutral particle after the charge separation, since the internal charges are opposite and equally large.

The movement (to the right in FIG. 1) of cluster 2 leads to a collision (not shown) with target 1, as a result of which the cluster decomposes into fragments 5, 6 and 7, which move to the left due to an impact against the rigid boundary surface. In the right part of FIG. 1, the situation after the collision between cluster 2 and target 1 is shown. Cluster fragments 5, 6 and 7 move away from the boundary surface, with cation 4 and/or anion 3 being located on different fragments 5 and/or 6. The mutual Coulomb attraction is overcome by the inertial movement of cluster fragments 5 and 6. After the fragmentation, the mutual shielding of charge carriers 3, 4 disappears, so that two externally charged free particles arise with fragments 5, 6 which are available for a further application (see below).

FIG. 2 illustrates a modified embodiment of the present invention in which the loading of the cluster with the reaction partner occurs during the collision with the boundary surface only. According to the left part of FIG. 2, cluster 10 moves toward the surface of target 1, which is made of, for example, gold and which carries adsorbates 11 on its surface which represent the reaction partner for charge carrier separation in the cluster. The covering of the substrate surface is performed via a reaction partner supply unit 12, which is formed, for example, by a vaporization furnace. According to the present invention, it may be provided that adsorbates are continuously supplied to the substrate surface via reaction partner supply unit 12, in order to replace adsorbates which are removed during continuous cluster surface impacts and thus to maintain a surface covering which is constant in its temporal average. In this way, an ion source which operates continuously during the cluster bombardment is provided.

During the collision, not shown, of cluster 10 with the adsorbate-covered surface of target 1, cluster 10 absorbs at least one adsorbate atom or molecule from target 1. The atom or molecule is dissolved in the carrier substance of the cluster as the reaction partner. In the cluster, a chemical reaction occurs immediately between the absorbed reaction partner and at least one cluster component, which leads to ionic products (charge carrier separation). After the collision of cluster 10 with the adsorbate-covered surface of substrate 1 (see FIG. 2, right part), cluster fragments 13, 14 and 15, formed by the interaction of the cluster at the boundary surface, move away from the surface of substrate 1. The ionic products arising through the absorption of adsorbate 11 in cluster 10 are located on different fragments 13, 14 and move away from one another. The energy necessary for overcoming the mutual Coulomb attraction is again introduced by the inertial movement of the cluster fragments. Cluster fragments 13, 14 form externally charged free particles which are available for further applications.

The procedure illustrated in FIG. 2 is the basis for various applications of cluster fragmentation according to the present invention. Through the irradiation of the target surface with a cluster beam with continuous adsorbate supply, a continuously operating ion source is formed, for example. Instead of a flat target 1, a substrate made like a kind of mask, which is delimited with predetermined edges depending on the application, could also be provided, which forms a local ion source with specific geometrical properties upon irradiation with clusters. Alternatively, adsorbates could be removed from the surface in a targeted way and subjected to an analysis with the method. For this purpose, the charged fragments are, for example, transferred into a mass spectrometer using electric fields.

FIG. 2 simultaneously illustrates the application of cluster fragmentation according to the present invention for quantification and analysis of clusters and aerosol particles, particularly those of natural origin. In this case, incident particle 10 represents a cluster or an aerosol particle of possibly unknown composition, which was transferred from a sample chamber into the cluster fragmentation chamber by suitable devices. A reaction partner is supplied to cluster or aerosol particle 10 before fragmentation, which leads to the formation of charge carrier pairs in cluster or aerosol particle 10. The supply may, as shown, occur in the impact with a surface covered with the reaction partner. Since aerosol particles of natural origin have a large proportion of water and other polar molecules, an alkali metal atom is particularly advantageous as the reaction partner, since the alkali atom spontaneously emits its valence electron in a polar environment to form an alkali metal cation. All atoms with a low ionization energy under 10 eV are similarly suitable, particularly representatives of the 3rd main group. The charged fragments released by means of the cluster fragmentation may be supplied to a charge quantity determination to determine the concentration of the original clusters/aerosols in the sample volume and/or to a mass spectrometry analysis to determine the composition of the starting clusters and/or aerosols.

A special and unexpected aspect of the present invention is that only a very brief time window of an order of magnitude of 1 picosecond or less is available for the charge separation illustrated in FIG. 2 after the loading with the reaction partner during the collision with the boundary surface. This brief time is enough to achieve a sufficient separation of the delocalized charge carriers.

Figure 3:
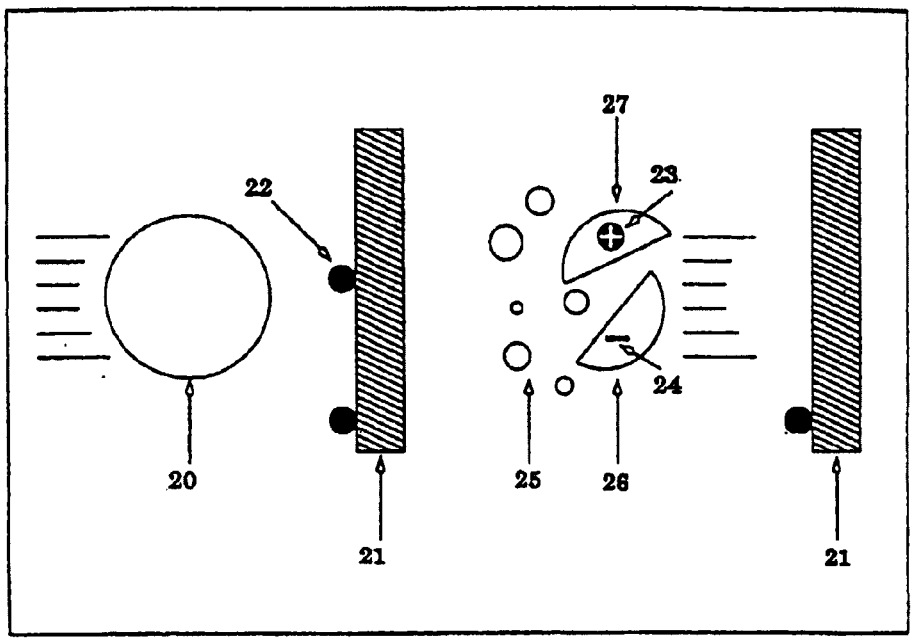
FIG. 3 shows an application of cluster fragmentation according to the present invention for surface analysis.

An alternative application of the principle shown in FIG. 2 is described in the following with reference to the analysis of surfaces illustrated in FIG. 3. The target is formed by a substrate 21. Substrate 21 is made of, for example, silicon. As shown in FIG. 3 (left part) adsorbates are located on the surface to be analyzed of substrate 21, e.g. in the form of sub-monolayers of electrically neutral alkali metal atoms (e.g. Li, K, Na, or Cs). The movement of cluster 20 leads to the collision with the surface, with cluster 20 absorbing an alkali metal atom 22. The alkali metal again spontaneously emits a valence electron to the cluster surroundings through the interaction with the polar $SO_2$ molecules, with an alkali cation 23 and a sulfur dioxide anion 24 being formed. The situation after the collision, not shown, is illustrated in the right part of FIG. 3. Cluster fragments 25, 26 and 27, formed as a result of the cluster fragmentation, move away from the surface of substrate 21, with charge carriers 23, 24, separated in original cluster 20, being located on different fragments 26, 27 and moving away from one another. As in the examples described above, the Coulomb attraction is compensated by the inertial movement of the ionized cluster fragments.

Free ions 26, 27 obtained after the spatial separation may be analyzed in a mass spectrometer in order to determine the composition of the absorbed surface adsorbates.

A particular advantage of the present invention is that the analysis of surface adsorbates may be expanded to a plurality of elements. In general, all elements which have a sufficiently low ionization energy are detectable.

Elements with ionization energies below 6.5 eV are preferably detected. In addition to the alkali metals mentioned, these also include the elements In, Y, Gd, U, Er, Tm, Tu, Sn, Ce, Pr, Ba, Rb, Yb, Tl, Th, Sr, La, Nd, Ra, Pu, Fr, Al, and Ga. There is particular interest, for example, in the trace analysis of radioactive substances, such as plutonium. The sensitivity achieved with the analysis method according to the present invention is approximately 1000 atoms/$cm^2$. This corresponds to a covering of $10^{-10}$ monolayers. In addition, large areas (e.g. 1 $cm^2$) of the substrate to be analyzed are detected by a cluster irradiation, so that a raster-like scanning of large surfaces is effectively possible. This represents a decisive advantage relative to other highly sensitive methods for trace analysis, such as the SIMS method, in which only small measurement spots in the sub-millimeter range may be detected. For example, a larger surface, e.g. the surface of a container for radioactive material, cannot be scanned with the SIMS method within measurement times of actual interest.

Figure 4:
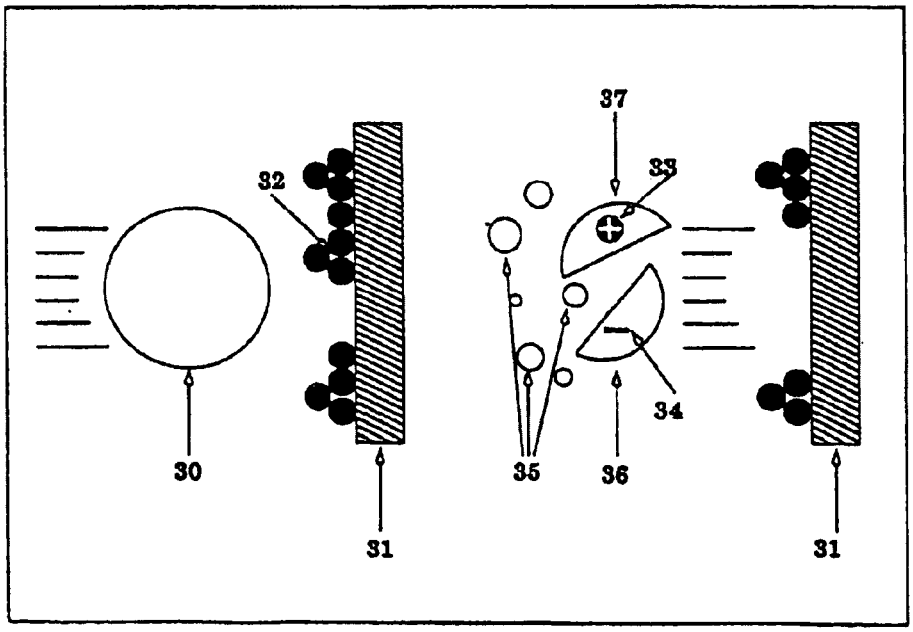
FIG. 4 shows an application of cluster fragmentation according to the present invention for surface purifying.

The method illustrated in FIG. 3 may also be correspondingly used for purifying substrate surfaces. As shown in FIG. 4 (left part), a cluster 30 made of polar molecules (e.g. sulfur dioxide) moves toward substrate 31 to be purified. Substrate 31 has impurities in the form of electrically neutral adsorbates, e.g. alkali metal adsorbates 32. During the collision, not shown, of cluster 30 with substrate 31, adsorbate 32 is absorbed and removed with the cluster fragments. In the right part of FIG. 4, the situation after the collision is illustrated. The quantity of the adsorbate on substrate 31 is reduced. The impurities are removed from the boundary surface and simultaneously transferred into ionic particles which may be particularly easily suctioned away with electromagnetic means. The free ions may in turn be subjected to analysis to determine the composition of the surface impurity. If the type of impurity is known, mass spectroscopy analysis may also be dispensed with and a charge measurement may be performed in its place. The total charge of one of the two polarities is determined with the charge measurement and the degree of impurity and/or the progress of the purification may be directly inferred from this.

Figure 5:
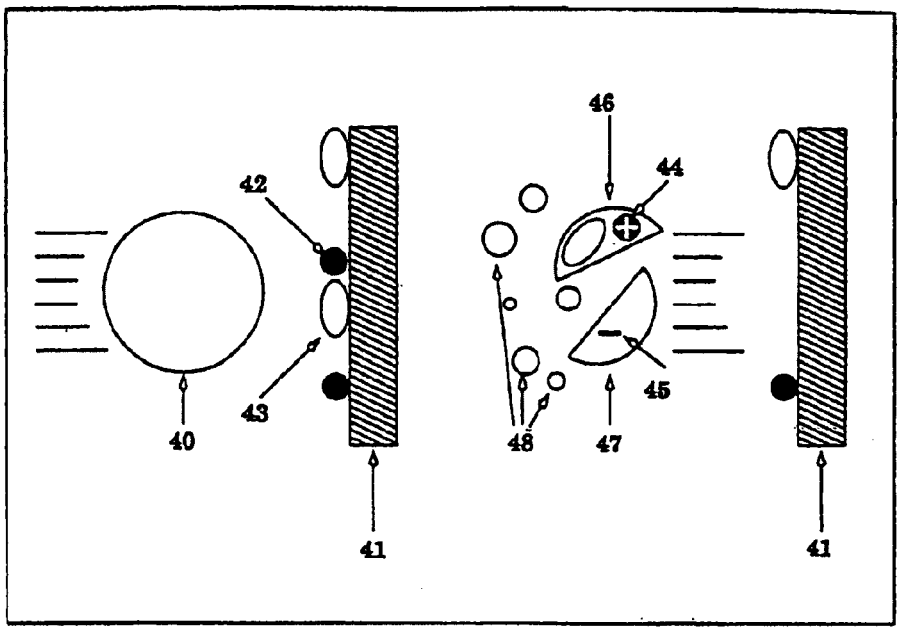
FIG. 5 shows an illustration of the absorption of neutral surface adsorbates.

An expansion of the principle of cluster loading at the boundary surface ("pickup" loading) illustrated in FIG. 2 according to a further embodiment of the present invention is shown in FIG. 5. As shown in the left part of FIG. 5, a large cluster 40 made of molecules with low electron affinity, e.g. ammonia molecules, moves toward target 41. The boundary surface is formed by the transition between the gas phase and the target made of, for example, gold. The boundary surface is coated with electrically neutral alkali metal adsorbates 42, e.g. Li, K, Na, or Cs, and further neutral molecules 43. Molecules 43 include, for example, organic molecules or macromolecules, such as a section of DNA. During the collision, not shown, between cluster 40 and target 41, cluster 40 may, as described above, absorb alkali metal adsorbate 42 and/or neutral molecule 43 and detach them from boundary surface 41.

If cluster 40 only absorbs molecule 43 during the collision and no reaction occurs between the cluster and the molecule, only its transfer into the gas phase occurs. After the diminution of the cluster envelope around molecule 43 by the collision-induced fragmentation, thermal energy withdrawal may occur through evaporation of individual components of the respective cluster fragment, so that at the end the neutral molecule is brought into the gas phase with only minimal internal energetic excitation. The number of cluster components which surround the molecule may be reduced down to 0 at the same time. This method represents an extremely careful transfer of neutral molecules into the gas phase, which is particularly of interest for sensitive, biologically active macromolecules.

If cluster 40 only absorbs alkali metal adsorbate 42 during the collision with the boundary surface, this adsorbate spontaneously emits a valence electron to the surroundings in the cluster due to the interaction with the polar ammonia molecules of cluster 40, with an alkali cation 44 and a delocalized electron 45 being formed. Due to the lack of electron affinity of molecular ammonia, there is not, however, formation of ammonia anions. The delocalized electron may either be stabilized by dipole cages in the cluster or may also transfer into the gold solid body during the collision or form a free electron outside the cluster.

If cluster 40 absorbs both alkali adsorbate 42 and neutral molecule 43 during the collision, the processes described above result again, with the delocalized electron also able to be stabilized by molecule 43. Furthermore, alkali cation 44 may also come to rest on the same cluster fragment as molecule 43, so that the ionization of molecule 43 is also achieved simultaneously with its transfer into the gas phase. After this non-destructive ionization, the molecule ion, which is also characterized by a low kinetic energy, may be subjected directly to a mass spectroscopy analysis.

Figure 6:
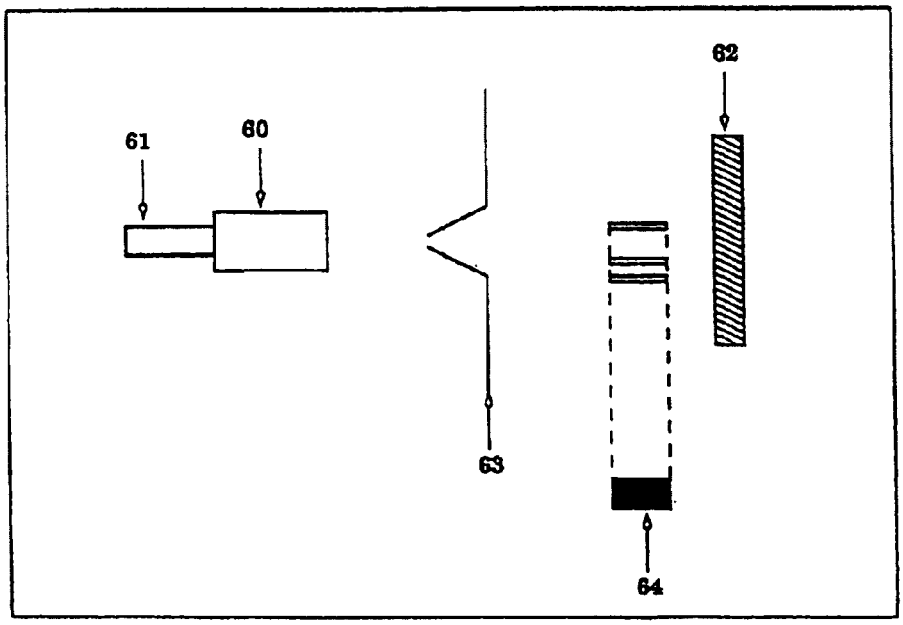
FIG. 6 shows a first embodiment of a cluster fragmentation device according to the present invention which is implemented for the analysis of surface adsorbates.

FIG. 6 shows an embodiment of a device according to the present invention for investigating and/or modifying boundary surfaces in the form of a cluster beam system. The cluster beam system is located in a multipart reaction chamber (not shown), which is, for example, constructed like a typical two-chamber molecular beam apparatus (background pressure without cluster beam $10^{-6}$ mbar . . . $10^{-7}$ mbar). The cluster beam system includes a cluster production device 60, 61, possibly with a beam limiter 63, a cluster fragmentation device 62, and a measurement device 64. Furthermore, control and steering devices for the ionized cluster fragments could also be provided, which, however, are known per se as manipulators for charged particles and therefore are not shown separately. The cluster production device includes a nozzle 60 and a supply system 61. The nozzle is preferably a pulsed nozzle with parameters selected depending on the application, but may also be operated continuously.

Typical parameters for pulsed operation are, for example, a nozzle diameter of 0.5 mm, a pulse width of 400 μs, and a stagnation pressure of up to 20 bar. The nozzle is supplied with an operating gas via a supply system 61, which comprises the carrier substance of the clusters to be produced or a gas mixture of the carrier substance and an inert additive or a gas mixture of the carrier substance and the reaction partner. The operating gas is, for example, a mixture of sulfur tetrafluoride and helium. The operating gas is expanded with a specific expansion ratio (e.g. 1:30), selected depending on the application, at nozzle 60. In the part of the reaction chamber downstream from nozzle 60, a pressure of approximately $10^{-3}$ mbar obtains. After the expansion, the cluster formation occurs by condensation in a way known per se. The cluster size distribution may be measured with a retarding field technique, such as that described by O. S. Hagena et al. in "J. Chem. Phys.", Vol. 56, 1972, p. 1793 et seq., using a 30 eV electron impact ionization.

The addition of the inert gas during cluster production is used to influence the cluster speed during cluster production. For example, Ne, He, or $H_2$ are used as inert gases. The cluster sizes and speeds depend on the quantity of inert gas and the gas pressures during the expansion. For the parameters described above, values in the range from 750 $ms^{-1}$ to $2.5 \cdot 10^3$ $ms^{-1}$ result for the cluster speed, with an average cluster size in the range of 1 to 750 atoms or molecules.

The cluster beam emitted from the nozzle opening is restricted in its radial expansion by beam limiter 63 (skimmer) and hits the cluster fragmentation device, which is formed in the example shown by a solid body surface 62 (target) positioned in the beam direction.

The skimmer is used for pressure reduction and to introduce a local resolution during the target irradiation (irradiation of a specific sample area). Performing the cluster fragmentation at a pressure which is lower than the atmospheric pressure has the advantage that in this way greater free path lengths for the moving clusters and ionized cluster fragments are provided. The radial restriction of the cluster beam allows locally resolved ion signals to be obtained from the boundary surface and thus a locally resolved surface analysis (down to the mm . . . μm range) to be performed. Solid body surface 62 forms the boundary surface for cluster fragmentation and is made of, for example, a dielectric, silicon, gold, or steel. The distance of the target (solid body surface 62) from the nozzle is approximately 30 cm for a measurement layout. The cluster beam diameter on the target is approximately 8 mm. It may be provided that the target is kept at a specific operating temperature, e.g. in the range from 400 K to 600 K, with a temperature equalization device (not shown), in order to achieve conditions under which weakly bonded molecular adsorbates are already desorbed. After completion of the cluster fragmentation procedure described above at solid body surface 62, the cluster fragments move opposite to the original beam direction, and are deflected into the measurement unit 64.

Measurement unit 64 is a mass spectrometer, preferably a time-of-flight mass spectrometer, which is provided for mass analysis of the ionized cluster fragments. A time-of-flight mass spectrometer has the advantage relative to a quadrupole mass spectrometer, which could alternatively be used, of being capable of analyzing even larger masses, e.g. above the mass 200.

Figure 7:
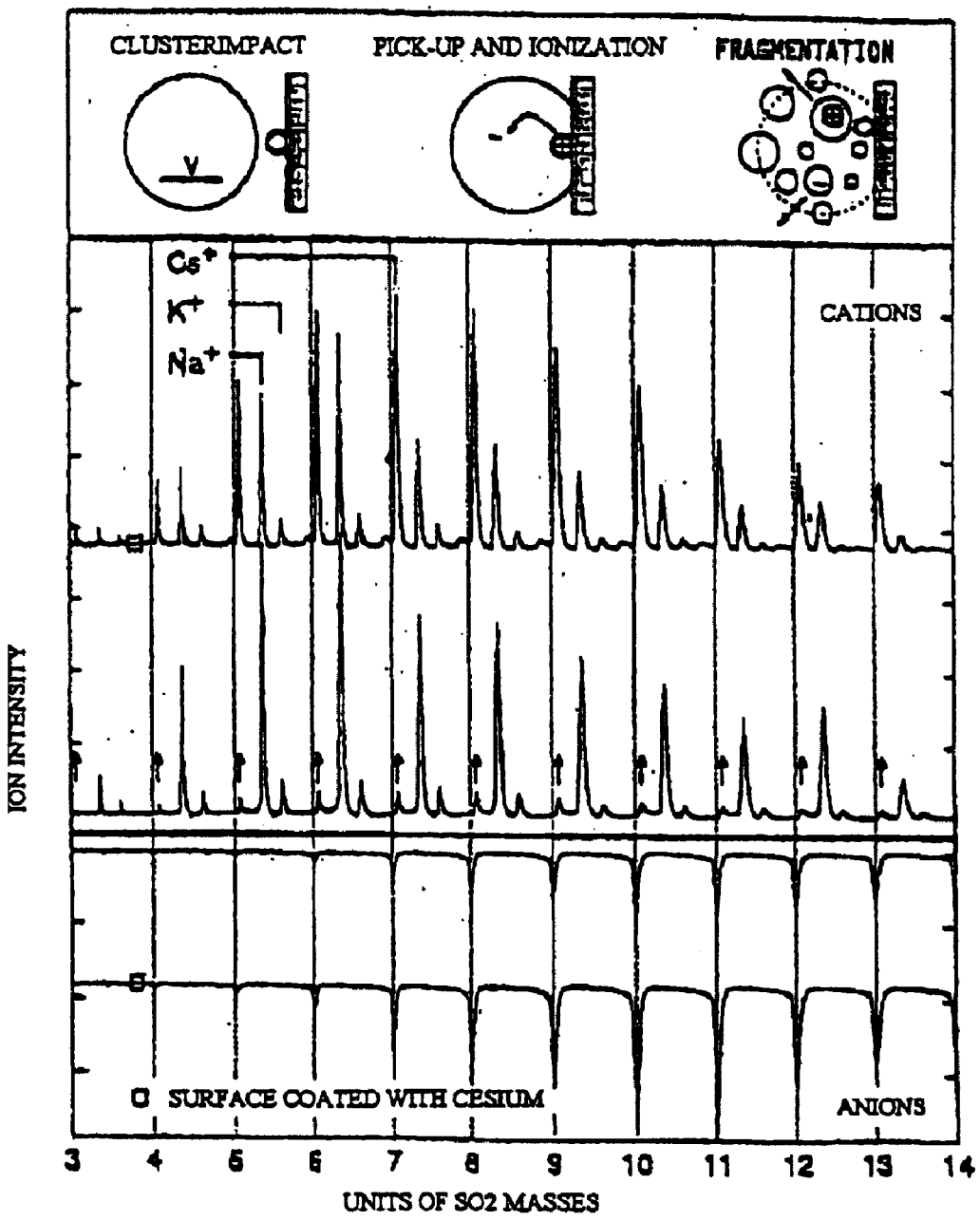
FIG. 7 shows curves to illustrate measurement results which were obtained with a device as shown in FIG. 6.

FIG. 7 shows the positive and negative mass spectra of the cations and/or anions of the cluster fragmentation according to the present invention on a gold surface. The reactive system selected comprises a cluster of polar $SO_2$ molecules and alkali atoms located on the impact surface. The reaction in the cluster comprises the spontaneous emission of the alkali valence electron to an $SO_2$ molecule, mediated by the polar surroundings. Formation of alkali cations and $SO_2$ anions occurs, which come to rest on cluster fragments due to the cluster fragmentation and are spatially separated from one another. The mass scale (abscissa) is plotted in units of $SO_2$ masses. The ordinate represents the measured ion count and/or ion intensity (arbitrary units). The two anion spectra (lower) show maxima of the form $(SO_2)_nSO_2^-$, as expected. In an experiment with an additional Cs coating of the surface (lower anion spectrum), this result was reproduced, with, however, the number of anion fragments being elevated.

In the two cation spectra (upper), maxima of the form $(SO_2)_nM^+$, with M=Na, K, Cs, are shown exclusively. As expected, all positive cluster fragments carry an alkali cation. If the surface is additionally coated with cesium, the $Cs^+(SO_2)_n$ maxima marked with arrows are significantly amplified (uppermost cation spectrum). Analogous fragment mass spectra were also found for other polar molecules, with $H_2O$, $NH_3$, and $SF_4$ clusters, with it being confirmed in each case that the positively charged cluster fragments each contained an alkali metal atom that had been absorbed from the irradiated boundary surface.

Cluster beam system 6 shown in FIG. 6 may be modified so that in place of measurement device 64, or as a supplement to it, a charge measurement device (not shown) is provided. This comprises, for example, a grid positioned at a slight distance in front of solid body surface 62 which has a predetermined voltage applied to it relative to the ground potential. Depending on the polarity of the voltage, one ion fragment type is drawn to the grid, while the respective other type is deposited on solid body surface 62, so that the surface becomes charged. This charge is measured with a charge measurement device. The number of ionized fragments may be derived directly from the charge quantity measured.

Figure 8:
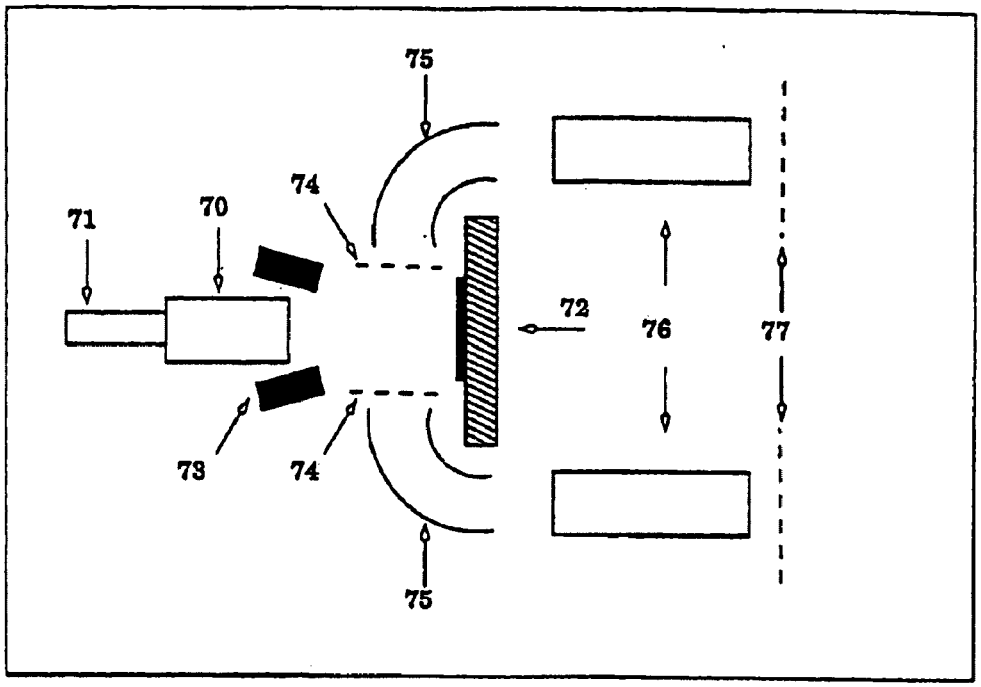
FIG. 8 shows a further embodiment of a cluster fragmentation device according to the present invention in the form of an ion thruster.

A further application of the cluster fragmentation method according to the present invention is illustrated in FIG. 8 with reference to the example of an ion thruster. Ion thruster 7 comprises a cluster production device 70, 71, a cluster fragmentation device 72, 73, control and steering devices 74, 75 and acceleration devices 76, 77. The overall ion thruster is designed for operation in an evacuated reaction chamber in the laboratory or in outer space. The cluster production device further includes a pulsed nozzle 70 and a supply system 71. A gas mixture, made of, for example, sulfur dioxide and helium and/or $H_2$, is led from supply system 71 to nozzle 70 and expanded after passing through the nozzle. The expansion ratio is, for example, 1: 10. The cluster beam emitted from the nozzle opening hits target 72 of the cluster fragmentation device, which also includes adsorbate supply devices 73. Target 72 is at ground potential and is continuously coated with adsorbates during the operation of the ion thruster by adsorbate supply units 73, e.g. in form of evaporation furnaces. Clusters made of polar carrier molecules and adsorbates made of alkali metal atoms, e.g. cesium, are preferred. The positive and negative cluster fragments arising in the course of the collision of the cluster with adsorbate-coated target 72 are spatially separated with the aid of outlet grid 74 and deflected in the desired direction by means of magnetic and/or electric steering devices 75. Subsequently, the separated fragments enter acceleration device 76, 77, which includes electrode tubes 76 and exit grid 77. Electrode tubes 76 are made of metal and have an electric potential, which changes over time and is adjusted to the cluster pulses (impact, for example, every 100 ms), relative to the ground potential applied to them. Exit grid 77 is at ground potential. Electrode tubes 76 are driven in such a way that after the cluster fragments enter, a polarity-dependent acceleration toward the exit grid occurs. To achieve the desired potentials, voltages in the amount of a few tens of kV are typically applied to electrode tubes 76.

A particular advantage of ion thruster 7 relative to conventional ion thrusters is that two charged fragments are produced simultaneously each time by the cluster fragmentation, which may both be used for thrust production. Furthermore, particularly heavy ions may be provided with cluster fragmentation, so that the thrust of the ion thruster is elevated.

The cluster fragmentation method according to the present invention may be set up by suitable selection of the carrier material of the cluster and the geometry of the impact of the cluster on the boundary surface so that, as a result of the cluster production, particularly large, positively charged cluster fragments occur predominantly. The production of particularly large fragments which essentially have the same size as the starting cluster particularly has advantages in the operation of the ion thruster. The large cluster fragments have a large mass and therefore a high impulse. The tailoring of material and geometry is based on the following concept.

A substance with or without an imperceptibly low molecular electron affinity is used as the carrier material. Examples of this are given by $NH_3$ or $H_2O$. In contrast to the use of $SO_2$, which has a high molecular electron affinity (see above), the electron of the charge carrier pair present in the cluster is not absorbed by the carrier material. Instead, it is transferred to the target or into free space. As a result, only positive (and possibly neutral) cluster fragments are present. To encourage this transition of the electron to the target, the target is preferably made of a metal with a high work function (e.g. tungsten).

In order to now make the remaining positively charged cluster fragment as large as possible, impact on the boundary surface occurs at an angle not equal to 0° (relative to the surface normal). A glancing blow at, for example, 70 to almost 90° (relative to the surface normal) is implemented, upon which relatively little kinetic energy is transferred to the cluster and used for its fragmentation. As a result of the fragmentation, relatively large fragments are present. For example, upon impact on the boundary surface with clusters made of, for example, 100 atoms, with a glancing incidence, a positively charged fragment with, for example, 80 to 90 atoms may still be present after the fragmentation.

Figure 9:
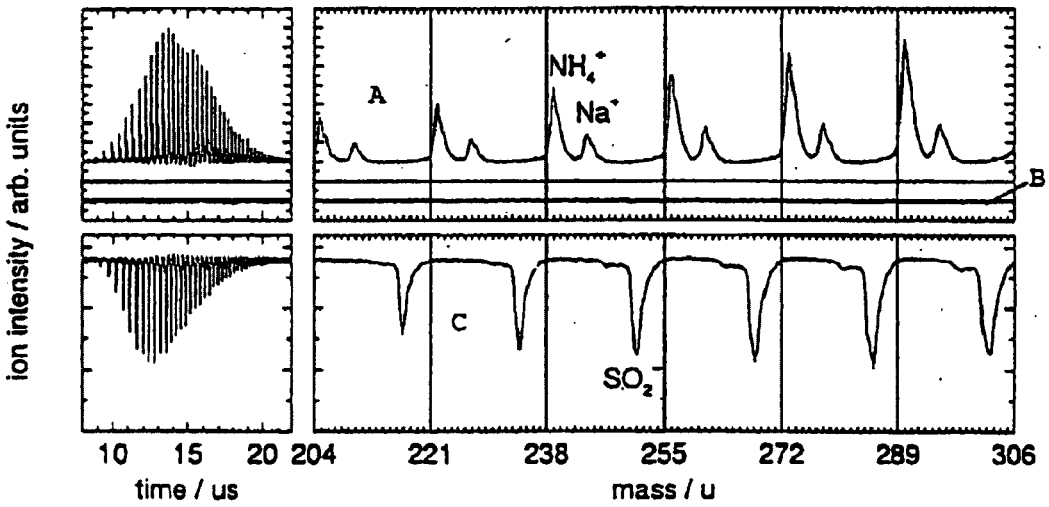
FIG. 9 shows curves to illustrate further measurement results.

The production of predominantly positive cluster fragments is illustrated in FIG. 9. FIG. 9 shows the result of the mass spectrometry examination of fragments from glancing impact by $NH_3$ clusters (curves A, B) and/or $SO_2$-doped $NH_3$ clusters (curve C) on a target coated with Na atoms. In the left part of FIG. 9, the clusters with various masses incident over the course of time are shown. In the right part of FIG. 9, the mass distribution of the clusters within a narrow time range is illustrated. The analysis of the positive clusters (curve A) results in a picture analogous to FIG. 7 for pure $NH_3$ clusters. The maxima corresponding to the multiples of the solvatized $Na^+$ ions are recognizable. During the measurement of negatively charged clusters (curve B), no maxima occur.

No negatively charged clusters are detectable. The negative charge carriers (electrons) have flowed to the target or into free space. If doping of the clusters with $SO_2$ is performed, then the picture known from FIG. 7 is also measured in the negative channel of the mass spectrometer. In this case, the electrons are taken over from $SO_2$. Corresponding negatively charged cluster fragments are detectable.

The present invention may be modified as follows relative to the examples described. For loading the clusters with the reaction partner, the carrier substance and the reaction partner may participate as two reaction partners (e.g. $H_2O$ and $NH_3$) even during the cluster production. The cluster is then constructed during the adiabatic expansion of a mixture of both reaction partners. This has the advantage of a high density of reactive particles in the cluster, which may also be adjusted via the gas composition. To load the clusters during collision with the boundary surface, instead of coating the boundary surface with adsorbates as described, it may also be provided that the reaction partner is a component of the boundary surface itself or forms the boundary surface. This has the advantage that the quantity of charge carrier pairs in the cluster may be controlled via the surface density of the reaction partner. There is the advantage relative to gas phase loading that each cluster interacts with the surface and therefore potentially with reaction partners, so that low efficiencies, corresponding to the low impact cross-sections in the gas phase, may be avoided. Depending on the application, it is possible to fragment single clusters or cluster beams.

Special arrangements for controlling the gas composition, the temperature of the expansion nozzle, and expansion pressure to influence the cluster speed and average cluster size in the beam may be provided for the adiabatic expansion during the cluster production. This has the advantage that the charge carrier production during the cluster fragmentation is influenced by adjustment of the cluster size and the kinetic energy of the clusters. By mixing lighter gas components with heavier gas components, the speed of the heavier components may be elevated ("seeded-beam" technology). The available energy range per particle is in the range from approximately 0.1 to 1 eV in this case.

During the cluster production, a step for ionization of the clusters with a subsequent acceleration of the cluster ions in electromagnetic fields may be provided. The ionization may be performed according to the cluster fragmentation method according to the present invention or according to a typical ionization method. The use of ionized clusters for further cluster fragmentation has the advantage that the kinetic energy relevant for cluster fragmentation may be freely set over a wide range. Correspondingly, for example, a multiple repetition of the cluster fragmentation method according to the present invention may be performed sequentially. A first repetition is directed toward the production of charged cluster fragments, which are then, for example, accelerated in electromagnetic fields in order to produce charged cluster fragments again by means of a further repetition, which, however, have properties in another range of the parameter space of the kinetic energy.

If the boundary surface for cluster fragmentation is formed by gold, this has the advantage that the adsorption energies on gold surfaces are relatively low. In this way, the loading of the cluster with the reaction partner in the form of an adsorbate on the boundary surface is encouraged due to the low energy outlay. Furthermore, as a metal, gold is conductive, so that with appropriate electrical wiring the boundary surface does not become charged even during long method operation. The gold surface may have any desired electrical potential applied to it, so that the originating potential of the charge carriers obtained may be fixed and used for manipulation of the charge carriers, particularly during their acceleration. A cluster beam system according to the present invention may be equipped with a device for setting the electrical potential of the boundary surface to set a specific originating potential of the cluster fragments.

If the cluster fragmentation is performed on semiconductor surfaces, this has the advantage that these surfaces are easily commercially available, particularly with high purity. In addition, the surface properties of semiconductors are well-known. Semiconductor surfaces may be produced with a particularly low roughness, which could have negative effects on the charge carrier yields via elevated charge carrier capture by the surface. Finally, semiconductors may have their conductivity and also the electrical and dialectical properties of the boundary surface changed via doping. With suitable doping, an electric charge of the boundary surface may be avoided, even during long-term method operation. The originating potential of the fragment ions produced may also again be set.

Cluster production through ultrasound expansion of a gas or gas mixture has the advantage that the clusters arise in the form of a directed beam at high density. The cluster beam has already been implemented at approximately 10 nozzle diameters. Furthermore, the clusters receive sufficient kinetic energy during the production, so that a reacceleration of the clusters is not absolutely necessary. Finally, relatively light gas phase reaction partners may be integrated into the clusters even during the expansion. The beam diameter on the target is proportional to the nozzle-target distance and is, for example, approximately 8 mm for a distance of 30 cm and usage of a skimmer.

The ability to analyze and measure the cluster fragments in real time allows the cluster fragmentation method to be integrated into a control method, in order to be able to correct method parameters according to the method success or the progress of the surface modification.

The invention claimed is:

1. A method for cluster fragmentation comprising the steps: producing a neutral cluster comprising a carrier substance comprised of polar molecules, said cluster comprising at least 10 of said polar molecules, loading said neutral cluster with at least one reaction partner, said step of loading said cluster comprises the step of applying neutral molecules as an absorbate coating to a solid body surface, said reaction partner being chemically different from the carrier substance, said at least one reaction partner forming at least one pair of electrically differently charged charge carriers with the carrier substance in the cluster, either spontaneously or excited from the outside, and fragmenting the cluster into a plurality of cluster fragments, such that at least one positively charged and at least one negatively charged cluster fragment is formed during the fragmentation, and the at least one reaction partner is part of at least one cluster fragment after the fragmentation, and the cluster fragments are spatially separated.

2. The method according to claim 1, further comprising the step of loading the cluster with an electrically neutral molecule.

3. The method according to claim 1, wherein the cluster fragmentation occurs through collision of the cluster with a moving or static boundary surface or through direct energy input.

4. The method according to claim 1, wherein the loading with the reaction partner occurs by at least one method, either alone or in combination, selected from the group consisting of; loading during the cluster production, loading during the cluster movement toward a boundary surface by interaction with at least one gas phase particle of the reaction partner, and loading during the collision with a boundary surface by absorption of reaction partner adsorbates into the cluster.

5. The method according to claim 1, wherein polar molecules or molecule groups are used as the carrier substance.

6. The method according to claim 1, wherein an electron transfer occurs between the carrier material and the reaction partner.

7. The method of claim 6, wherein the reaction partner is a molecule or atom having low ionization energy.

8. The method of claim 7, wherein the reaction partner is an alkali atom.

9. The method according claim 1, wherein a proton transfer occurs between the carrier material and the reaction partner.

10. The method of claim 9, wherein the reaction partner is a strong acid and the carrier material is a strong base.

11. The method of claim 9, wherein the reaction partner is a strong base and the carrier material is a strong acid.

12. The method according to claim 1, wherein said step of production of said neutral cluster comprises at least one method, either alone or in combination, selected from the group consisting of; supersonic expansion of a gas and supersonic expansion of a gas mixture by means of a nozzle arrangement.

13. The method according to claim 12, wherein the clusters produced are subjected to geometric beam limiting for irradiating a boundary surface according to a predetermined pattern.

14. The method according to claim 1, further comprising the step of influencing kinetic energy of the charged cluster fragments by at least one method, either alone or in combination, selected from the group consisting of; subjecting the cluster fragments to an electrical field and subjecting the cluster fragments to a magnetic field, and subjecting the cluster fragments to a further fragmentation.

15. The method according to claim 1, further comprising the step of subjecting the cluster fragments to a count, a mass spectroscopy examination, or a material analysis.

16. The method according to claim 1, wherein the fragmentation of the cluster occurs by glancing incidence of the cluster on a boundary surface.

17. The method according to claim 3, wherein the boundary surface is a gas phase/liquid or gas phase/solid body boundary surface.

18. The method according to claim 17, wherein the boundary surface is formed by a solid body surface made of a metal, a semiconductor, or a dielectric.

19. The method according to claim 17, wherein the boundary surface is coated with reaction partner adsorbates with a surface density whose temporal average has a predetermined value.

20. The method according to claim 4, wherein the boundary surface is a gas phase/liquid or gas phase/solid body boundary surface.

21. The method according to claim 20, wherein the boundary surface is formed by a solid body surface made of a metal, a semiconductor, or a dielectric.

22. The method according to claim 20, wherein the boundary surface is coated with reaction partner adsorbates with a surface density whose temporal average has a predetermined value.

23. The method according to claim 13, wherein the boundary surface is a gas phase/liquid or gas phase/solid body boundary surface.

24. The method according to claim 23, wherein the boundary surface is formed by a solid body surface made of a metal, a semiconductor, or a dielectric.

25. The method according to claim 23, wherein the boundary surface is coated with reaction partner adsorbates with a surface density whose temporal average has a predetermined value.

26. The method according to claim 16, wherein the boundary surface is a gas phase/liquid or gas phase/solid body boundary surface.

27. The method according to claim 26, wherein the boundary surface is formed by a solid body surface made of a metal, a semiconductor, or a dielectric.

28. The method according to claim 26, wherein the boundary surface is coated with reaction partner adsorbates with a surface density whose temporal average has a predetermined value.

29. The method according to claim 1, wherein the carrier substance comprises a chemical compound which has such a low electron affinity that electrons are not stably bonded to a cluster fragment.

30. Method according to claim 1, said method being used:

for absorbing surface adsorbates from a surface which are to be subjected to an analysis, for absorbing impurities from solid body surfaces for their purification, or for producing charged cluster fragments from clusters and aerosols which are to be subjected to a charge measurement or mass spectrometry analysis.

* * * * *